US011925268B2

(12) United States Patent
Grubb

(10) Patent No.: US 11,925,268 B2
(45) **Date of Patent: *Mar. 12, 2024**

(54) FOLDOUT BED

(71) Applicant: Jeffrey A. Grubb, Yorba Linda, CA (US)

(72) Inventor: Jeffrey A. Grubb, Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/964,795

(22) Filed: Oct. 12, 2022

(65) Prior Publication Data

US 2023/0029992 A1 Feb. 2, 2023

Related U.S. Application Data

(63) Continuation of application No. 16/813,221, filed on Mar. 9, 2020, now Pat. No. 11,497,317.

(60) Provisional application No. 62/815,214, filed on Mar. 7, 2019.

(51) Int. Cl.

| | |
|---|---|
| ***A47C 19/12*** | (2006.01) |
| ***A47C 17/52*** | (2006.01) |
| ***A47C 19/02*** | (2006.01) |

(52) U.S. Cl.

CPC ..... *A47C 19/126* (2013.01); *A47C 17/52* (2013.01); *A47C 19/021* (2013.01)

(58) Field of Classification Search

CPC ..... A47C 17/38; A47C 17/52; A47C 19/126; A47C 19/021; A47C 19/005; A47C 19/12; A47C 19/124; A47C 19/122

See application file for complete search history.

(56) References Cited

U.S. PATENT DOCUMENTS

| | | | | |
|---|---|---|---|---|
| 2,257,625 | A * | 9/1941 | Thomas | A47C 17/46 5/2.1 |
| 7,937,787 | B2 * | 5/2011 | Whitford | A47C 17/46 5/139 |
| 8,898,831 | B1 * | 12/2014 | Burchett | A47C 17/52 5/164.1 |
| 2006/0031986 | A1 * | 2/2006 | Revels | A47C 17/38 5/162 |
| 2015/0059090 | A1 * | 3/2015 | Cacioppo | A47C 19/005 5/296 |
| 2016/0084000 | A1 * | 3/2016 | Schlanker | A47C 17/38 29/401.1 |

(Continued)

*Primary Examiner* — Justin C Mikowski
*Assistant Examiner* — Alison N Labarge
(74) *Attorney, Agent, or Firm* — Joseph A. Andelin; Fish IP Law, LLP

(57) ABSTRACT

A foldout bed is described. The foldout bed has a left side wall, a right side wall, and a top panel that extends between and attached to the top ends of the two side walls. The bottom end of each side wall is coupled with a counterbalance mechanism. A bed tray is pivotally coupled with a the counterbalance mechanisms and is transitionable between an open configuration and a closed configuration. The bed tray provides a unitary planar surface that is configured to support a mattress and a person when in the open configuration. Each counterbalance mechanism has a frame and a piston that attaches the frame to the bed tray. The frame has a base flange disposed perpendicular to the side walls and located at the bottommost end of the counterbalance mechanism against a base plate of the wall.

18 Claims, 7 Drawing Sheets

(56) References Cited

U.S. PATENT DOCUMENTS

| | | | | |
|---|---|---|---|---|
| 2017/0007028 | A1* | 1/2017 | Grubb | A47C 17/40 |
| 2017/0007029 | A1* | 1/2017 | Grubb | A47C 17/40 |

* cited by examiner

FOLDOUT BED

This application is a continuation of U.S. utility application Ser. No. 16/813,221, filed on Mar. 9, 2020, which claims the benefit of U.S. provisional utility application no. 62/815,214, filed on Mar. 7, 2019. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is furniture, more particularly foldout beds and containers for shipping foldout beds.

BACKGROUND

The following description includes information that may be useful in understanding the present invention. It is not an admission that any of the information provided herein is prior art or relevant to the presently claimed invention, or that any publication specifically or implicitly referenced is prior art.

In the early 1900's, a California inventor named William K. Murphy invented a space-saving bed that can be folded when not in use. Foldout beds, or "Murphy" beds, have been popular since then. Foldout beds can be mounted to the floor, secured to the wall behind the bed, or housed in free-standing cabinets. Foldout beds typically require a series of high-tension springs and/or pistons that serve as a counterweight to the bed frame to which they are attached.

In the time since Murphy's invention in the early 1900's, foldout beds have fit into one of two general categories. Beds in the first category, often called "closet beds," "cabinet beds," or "door beds," are similar to Murphy's original design, taught in U.S. Pat. No. 1,007,596. These designs have a counterbalance mechanism attached to both the bed frame and a support frame. These traditional bed assemblies are generally easy to install. However, the frame must be housed in a closet-style cabinet with doors to hide the counterbalance mechanism when in an upright position. Unfortunately, these closet-style cabinets can be quite cumbersome and expensive. Additionally, the doors are aesthetically undesirable when the bed is in an unfolded position because it makes the user feel like he/she is sleeping in a closet. The doors also occupy room space when opened, and prevent any furniture from being placed next to the bed. As a result, the traditional "closet bed" has somewhat fallen out of favor with consumers.

The other category, called "panel beds," solves the aesthetic problems of "closet beds" by placing the counterbalance mechanism within the housing along the sides of the bed frame, rather than between the bed frame and support frame. This counterbalance configuration allows for a panel to be directly attached to the underside of the bed frame, which eliminates the need for a door. When the bed is in a folded, upright position, all components of the bed assembly are hidden either within the housing or behind the panel, which can be stylized to look like a cabinet. Eliminating the need for a set of doors to conceal the bed makes "panel beds" less expensive overall than "closet beds" because there are fewer moving parts. However, although "panel beds" are aesthetically preferred and less complex than "closet beds," they can be difficult to ship and install due to the large size of the panels.

Others have attempted to solve the problem of shipping difficulty by splitting the bed into two articulating structures, like those taught in U.S. Pat. No. 6,990,698. Although this design does allow for greater ease of shipping due its platform design, the invention is limited to only a twin extra long size bed, and has generally wider footprint than the foldout bed which reduces the usable space of the bedroom in which it is installed.

In recent years, brick and mortar furniture businesses have been in a steady decline. However, during that time, the e-commerce based furniture business has grown. The ease and convenience of shopping on the Internet and having the purchased product delivered to your home has begun to outweigh any benefits derived by physically visiting certain stores. As such, there is a need for online products, especially larger items like furniture, to have better modular designs to decrease shipping costs. Industry standard parcel dimensions have been set by commercial parcel shipping companies (e.g., Fed-Ex, UPS) to allow for cheaper rates and faster deliver (e.g. 2-3 days instead of 2-6 weeks). It would be advantageous to provide modular furniture designs that can be divided into individual parts and grouped in shippable units that fit within these standard parcel dimensions, lowering the end cost to the consumer.

Thus, there is still a need for an improved foldout bed housing that can be more easily packaged, shipped via parcel carriers, and assembled in the consumer's home.

SUMMARY OF THE INVENTION

The inventive subject matter provides a housing for storing a mattress on a bed tray. The bed tray comprises a first panel, a second panel, a third panel, and a fourth panel. The first and second panels are hingeably coupled and the third and fourth panels are also hingeably coupled. Each pair of panels are transitionable between a folded and unfolded configuration. When the pair of panels are in a folded configuration, the panels are folded together to form a compact unit for packing and shipping as a parcel within the standard parcel carrier requirements. When the pair of panels are in the unfolded configuration, the pairs can be rigidly coupled to provide a planar surface. The housing also includes at least one counterbalance mechanism (e.g., a piston, a spring, etc.) coupled to a first and second side wall such that the counterbalance mechanism does not extend beyond the side walls. In a preferred embodiment, the counterbalance mechanism couples the bed tray to the first and second side walls by coupling one end of the counterbalance mechanism to the third panel with one or more fasteners, and the other end of the counterbalance mechanism to the fourth panel with one or more fasteners.

In preferred embodiments, the housing has a width of at least 65 inches (approximately 1644 millimeters), a length of 86 inches (approximately 2165 millimeters), and a depth of at least 16 inches (approximately 400 millimeters). In some embodiments, the housing contains a Queen bed, where the Queen bed has a width of at least 60 inches (approximately 152 millimeters) and a length of 80 inches (approximately 203 millimeters). The housing may also be configured to contain a Full bed having a width of 54 inches (approximately 135 millimeters) and a length of 75 inches (approximately 190 millimeters). In other embodiments, the housing may be configured to contain a Twin bed having a width of 39 inches (approximately 96 millimeters) and a length of 80 inches (approximately 190 millimeters).

The housing also includes a series of horizontal panels for coupling the first and second side walls. The horizontal panels comprise a top panel, a first back panel, a second back panel, and a front panel. Each of the components of the housing is sized and dimensioned to fit into one of four containers for packaging and shipping. The first and second side walls are made in two pieces and all the pieces are packaged together in one container. Each container is sized and dimensioned to a standard Package Measurement, called a "girth," of 130 inches or less.

A Package Measurement is defined herein as the summation of a container's length and girth. The length of a container is determined by measuring the longest side of the container. The girth of the container is determined by measuring the width and height of the container, doubling each measurement, and then adding the two products together. For example, the Package Measurement of a container with a width of 25 inches, a height of 20 inches, and a length of 30 inches, would be a girth of 120 inches ((25*2)+(20*2)+30).

Irregularly shaped components, such as those that are not substantially rectangular in shape, are treated as if they were in a regular rectangular container. The Package Measurement for irregularly shaped components is determined by measuring the length, width, and height of the component at its extreme points, doubling each of the resulting width and height measurements, and then adding the product to the length. For example, a widget has a width of 3 in at a first end point, a width of 4 inches at its midsection, and a width of 2 at its second end point. Its length is 20 inches, and its height is 20 inches at a first section and 15 inches at a second section. To calculate the Package Measurement of the widget, the most extreme width of 4 inches and most extreme height of 20 inches are both doubled, and the products are added to the length of 20 inches. Such that the Package Measurement of the widget would be girth of 68 inches ((4*2)+(20*2)+20).

The modular design of the bed housing provides for a flat packing configuration of the individual components (e.g., panels, frames, fasteners). Each of the housing components can be grouped together with other similar sized components, and shipped in a standardized containers (e.g., small parcels), within a standardized weight, for cheaper shipping.

Various objects, features, aspects and advantages of the inventive subject matter will become more apparent from the following detailed description of preferred embodiments, along with the accompanying drawing figures in which like numerals represent like components.

DETAILED DESCRIPTION

One should appreciate that the disclosed techniques provide many advantageous technical effects including providing foldable frame assemblies for foldout beds that are easy to manufacture, easy to install, and are aesthetically pleasing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
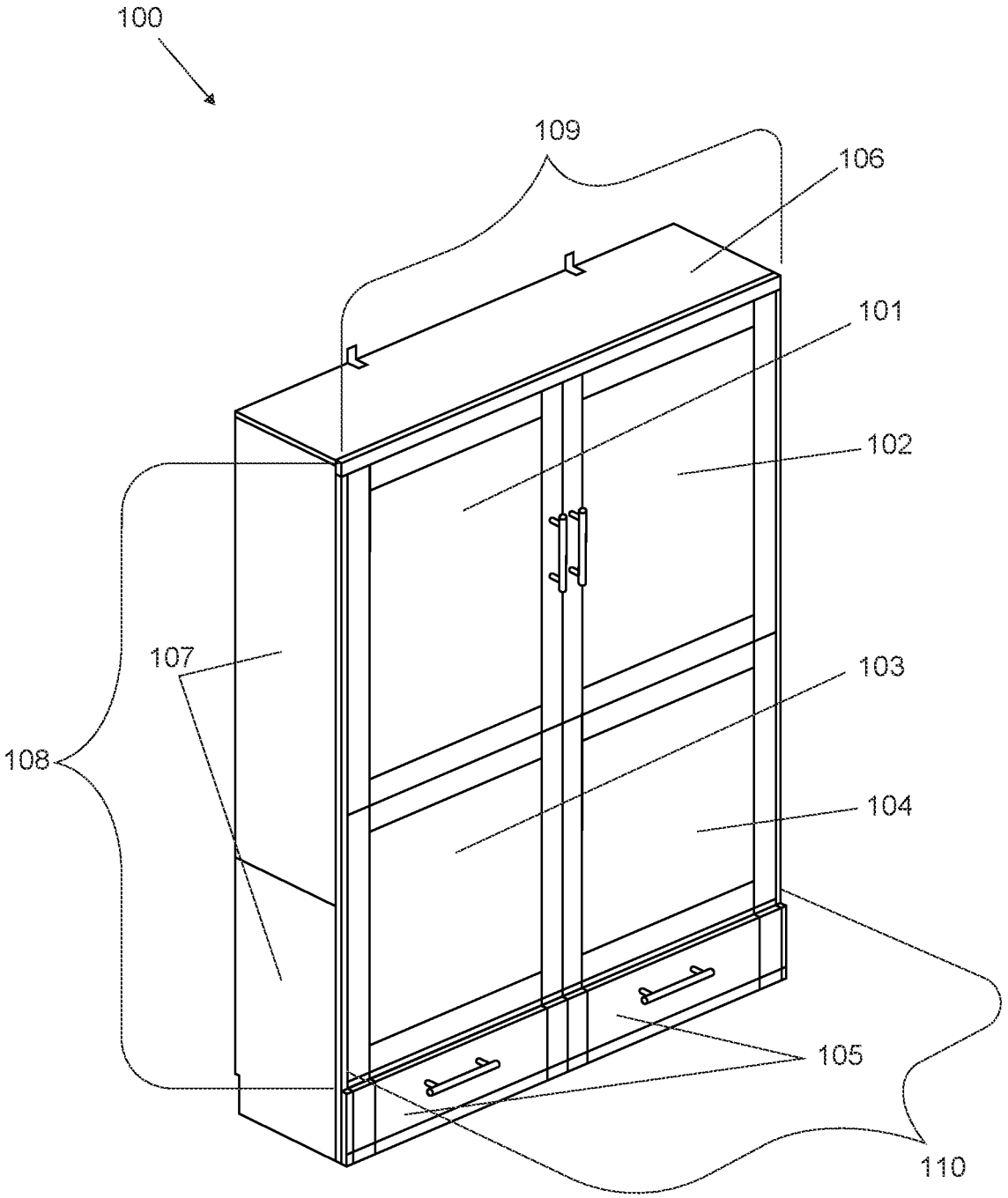
FIG. 1 is a front, top, left side perspective view of one embodiment of a housing for a foldout bed shown in a closed configuration.

FIG. 1 is a perspective view of a foldout bed housing 100. Housing 100 comprises a pivoting bed tray 108, a top panel 106, a first side wall 107, a second side wall 202, and front panel 105. Bed tray 108 comprises the first panel pair 109 and second panel pair 110 in an open configuration. First panel pair 109 is comprised of first panel 101 and second panel 102 in a fastened configuration. Second panel pair is comprised of third panel 103 and fourth panel 104 in a fastened configuration.

The fasteners for the first panel pair 109 and second panel pair 110 are disposed along the perimeter of the bed tray 108. The fasteners rigidly couple the second panel 102 to fourth panel 104, rigidly couple the first panel 101 to the second panel 102, rigidly couple the first panel 101 to the third panel 103, and the third panel 103 to the fourth panel 104.

Access to the bed tray 108 is provided by handles disposed on first panel pair 109. Bed tray 108 can be deployed (e.g., rotated downward) into a horizontal position and open configuration for sleeping as shown in FIG. 1. Bed tray 108 can also be retracted (e.g., rotated upward) into a vertical position and closed configuration for storage as shown in FIG. 2.

Figure 2:
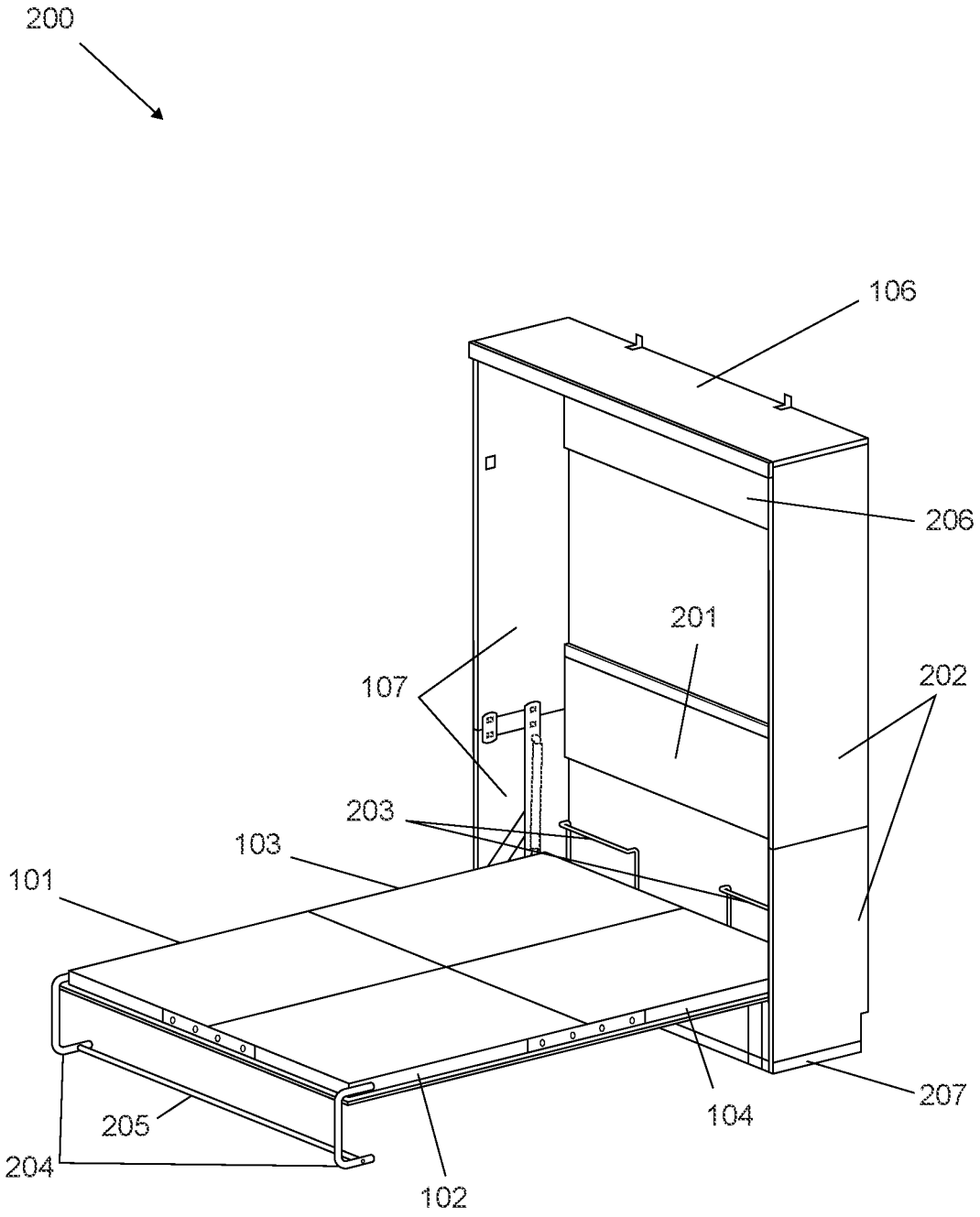
FIG. 2 is a perspective view of the housing of a foldout bed of FIG. 1 in an open configuration.

FIG. 2 is a side perspective view of housing 100 in an open configuration. When in the closed configuration, bed tray 108 is disposed perpendicularly to first side wall 107 and second side wall 202. Bed tray 108 further comprises mattress hooks 203 for retaining a mattress in housing 100 while in an open or closed configuration. Flip feet 204 are coupled with a flip foot rod 205 to provide elevated support for bed tray 108. Bed tray 108 and a mattress retained by mattress hooks 203 can be deployed into a horizontal surface for sleeping when housing 100 is in the open configuration. First back panel 201 can be rigidly coupled to the first side wall 107 and second side wall 202 to provide additional structural support to housing 100.

Figure 3A:
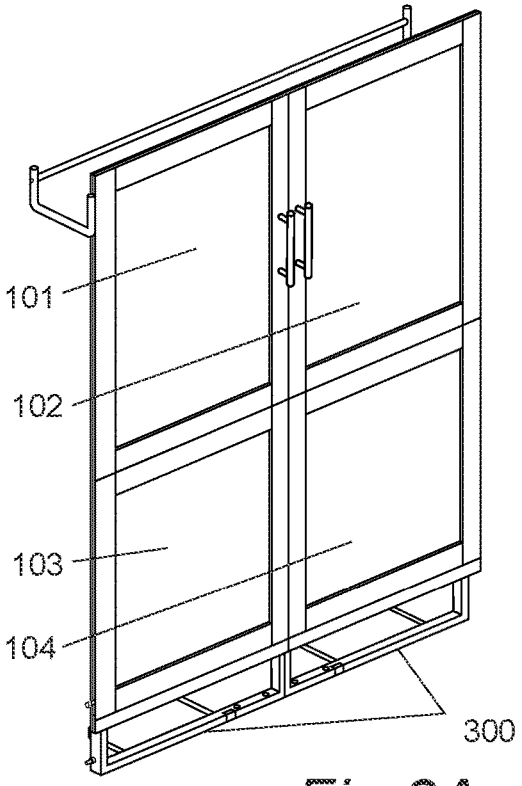
FIG. 3*a* is a front, top, left side perspective view of the bed tray of FIG. 1.
Figure 3B:
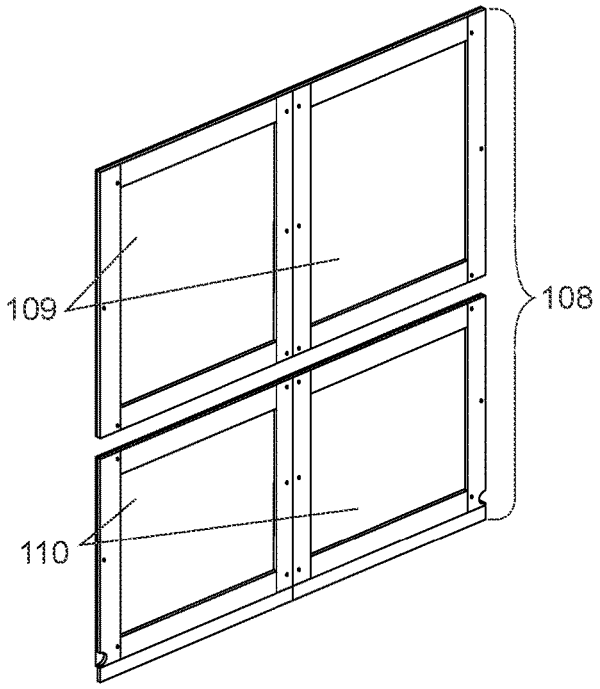
FIG. 3*b* is a front, top, left side perspective view of the first and second panel pairs separate, in an open configuration.
Figure 3C:
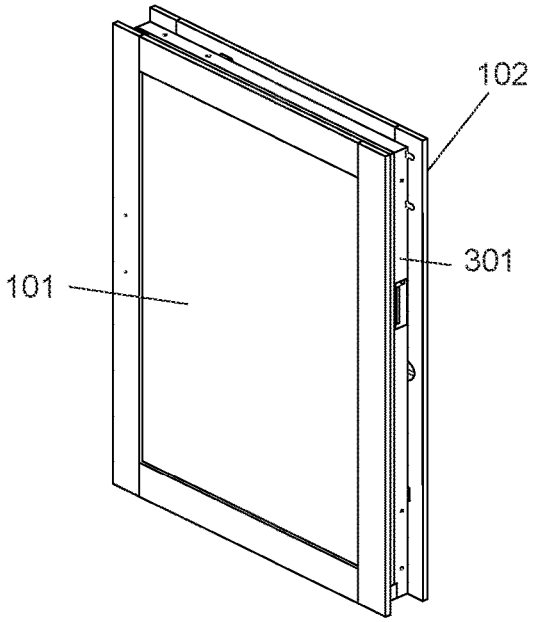
FIG. 3*c* is a top, front perspective view of the first panel pair in closed configuration.

FIG. 3*a* is a front perspective view of the bed tray 108. Second panel pair 110 further comprises frame 300. Lower panel frame 300 provides structural rigidity to bed tray 108 and is disposed behind front panel 105 of housing 100. FIG. 3*b* is a front perspective view of the first panel pair 109 and second panel pair 110 of bed tray 108 separated, where first panel pair 109 is disposed above second panel pair 110. FIG. 3*c* is a top, front perspective view of the first panel pair 109 in the folded configuration. In this embodiment, upper panel frame 301 is disposed between first panel 101 and second panel 102. First panel pair 109 is a hinged assembly wherein the outer surface of first panel 101 can be configured to be parallel to the outer surface of second panel 102 via upper panel frame 301.

Figure 3D:
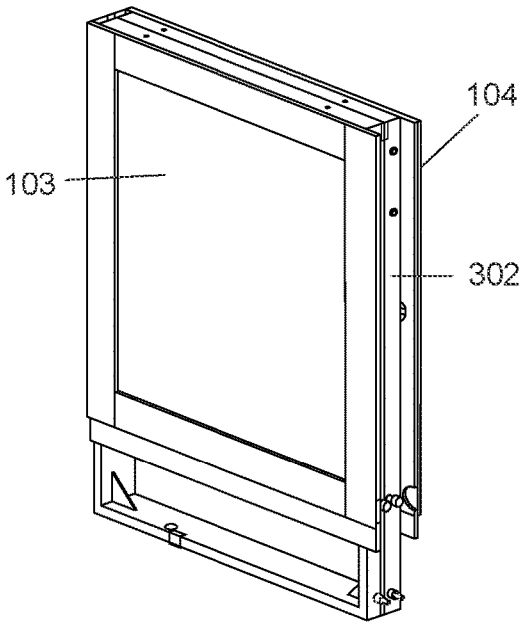
FIG. 3*d* is top, front perspective view of the second panel pair in closed configuration.

FIG. 3*d* is a top, front perspective view of the second panel pair 110 in folded configuration. In this embodiment, lower panel frame 300 is disposed between third panel 103 and fourth panel 104. Second panel pair 110 is a hinged assembly wherein the outer surface of third panel 103 can be configured to be in a parallel disposition to the outer surface of fourth panel 104 via lower panel frame 302.

Figure 4:
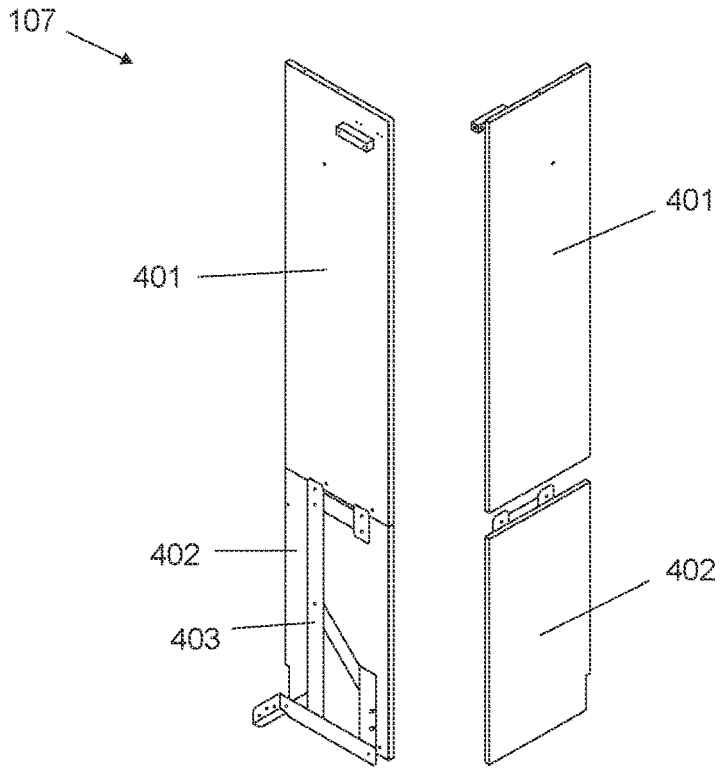
FIG. 4 is a back, top, right side perspective view of the left side wall of the housing of FIG. 1.

FIG. 4 is a back, top, right side perspective view of the left side wall 107 of the housing of FIG. 1. Left side wall 107 comprises an upper panel 401 and lower panel 402, which are rigidly coupled by first frame 403. The upper panel 401 is comprised of an inner surface and outer surface. The lower panel 402 is comprised of an inner surface and outer surface. The inner surface of lower panel 402 is coupled to first frame 403 via one or more fasteners.

Figure 5:
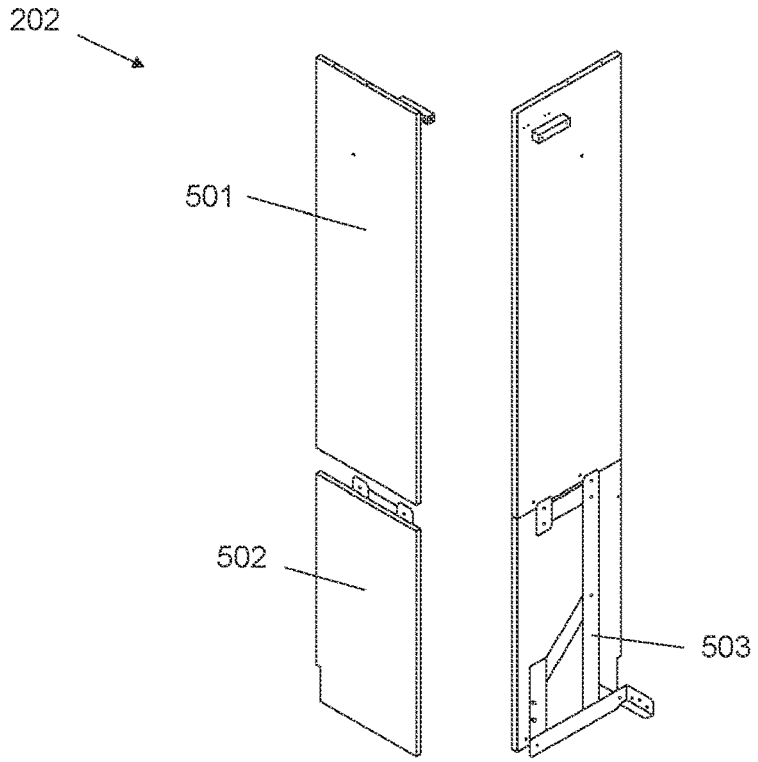
FIG. 5 is a back, top, right side perspective view of the right side wall of the housing of FIG. 1.

FIG. 5 is a back, top, right side perspective view of the right side wall 202 of the housing 100 of FIG. 1. Right side wall 202 comprises an upper panel 501 and lower panel 502, which are rigidly coupled by second frame 503. The upper panel 501 is comprised of an inner surface and outer surface. The lower panel 502 is comprised of an inner surface and outer surface. The inner surface of lower panel 502 is coupled to second frame 503 via one or more fasteners.

Figure 6A:
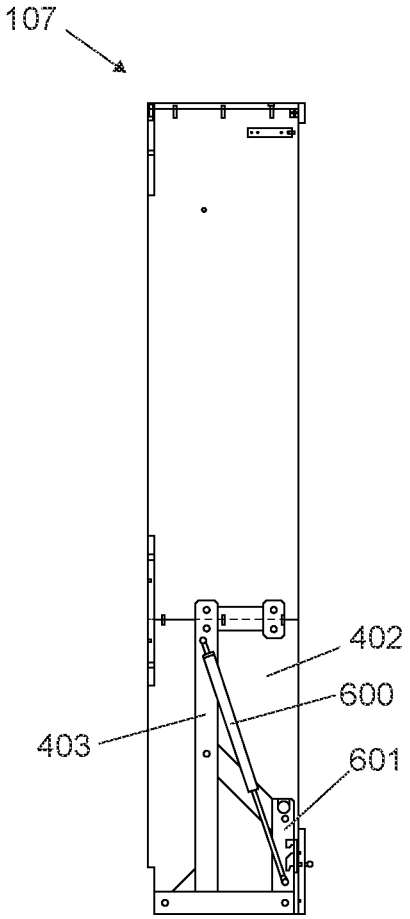
FIG. 6A is a side perspective view of the housing and left side of the counterbalance mechanism.
Figure 6B:
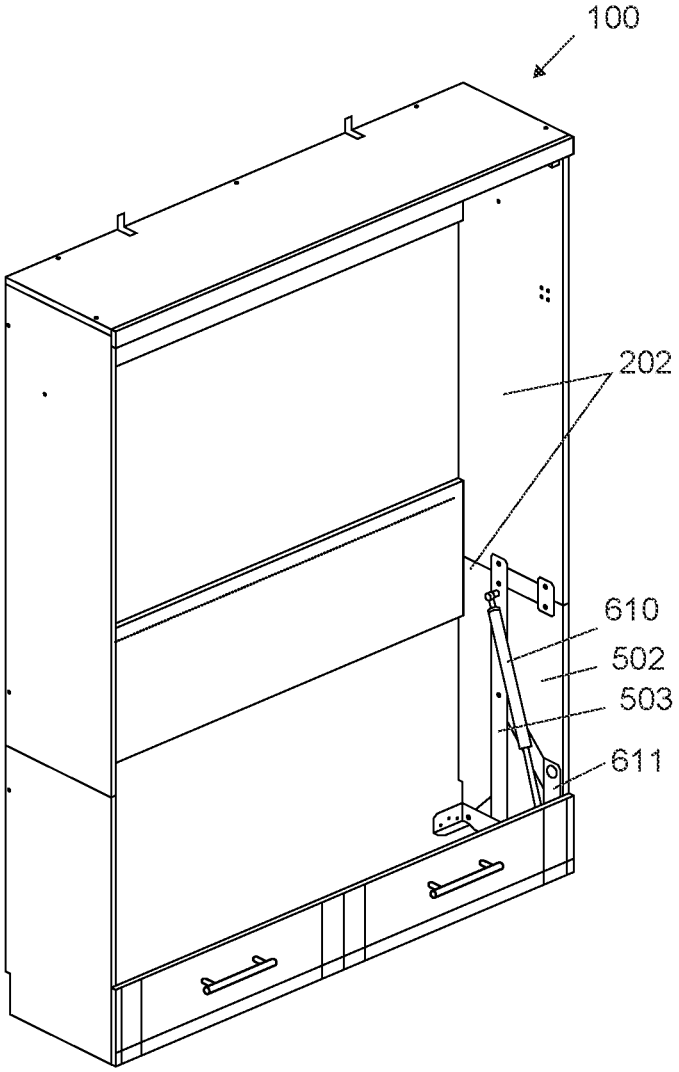
FIG. 6B is a top, left perspective view of the housing and the right side of the counterbalance mechanism.

In preferred embodiments, housing 100 further comprises a counterbalance mechanism, as depicted in FIG. 6A and FIG. 6B. The counterbalance mechanism comprises the first frame 403, the second frame 503, one or more fasteners for rigidly coupling the first frame 403 to the lower panel 402 of first side wall 107, one or more fasteners for rigidly coupling second frame 503 to the lower panel 502 of second side wall 202, a first piston 600, and a second piston 610. The first piston 600 rigidly couples the first frame 403 to right tray pivot structure 601. The second piston 610 rigidly couples the second frame 503 to left tray pivot point structure 611. Bed tray 108 is removably coupled to the right and left tray pivot point structures of first frame 403 and second frame 503 such that bed tray 108 may be rotated from an open to a closed configuration, and vice versa.

Figure 6C:
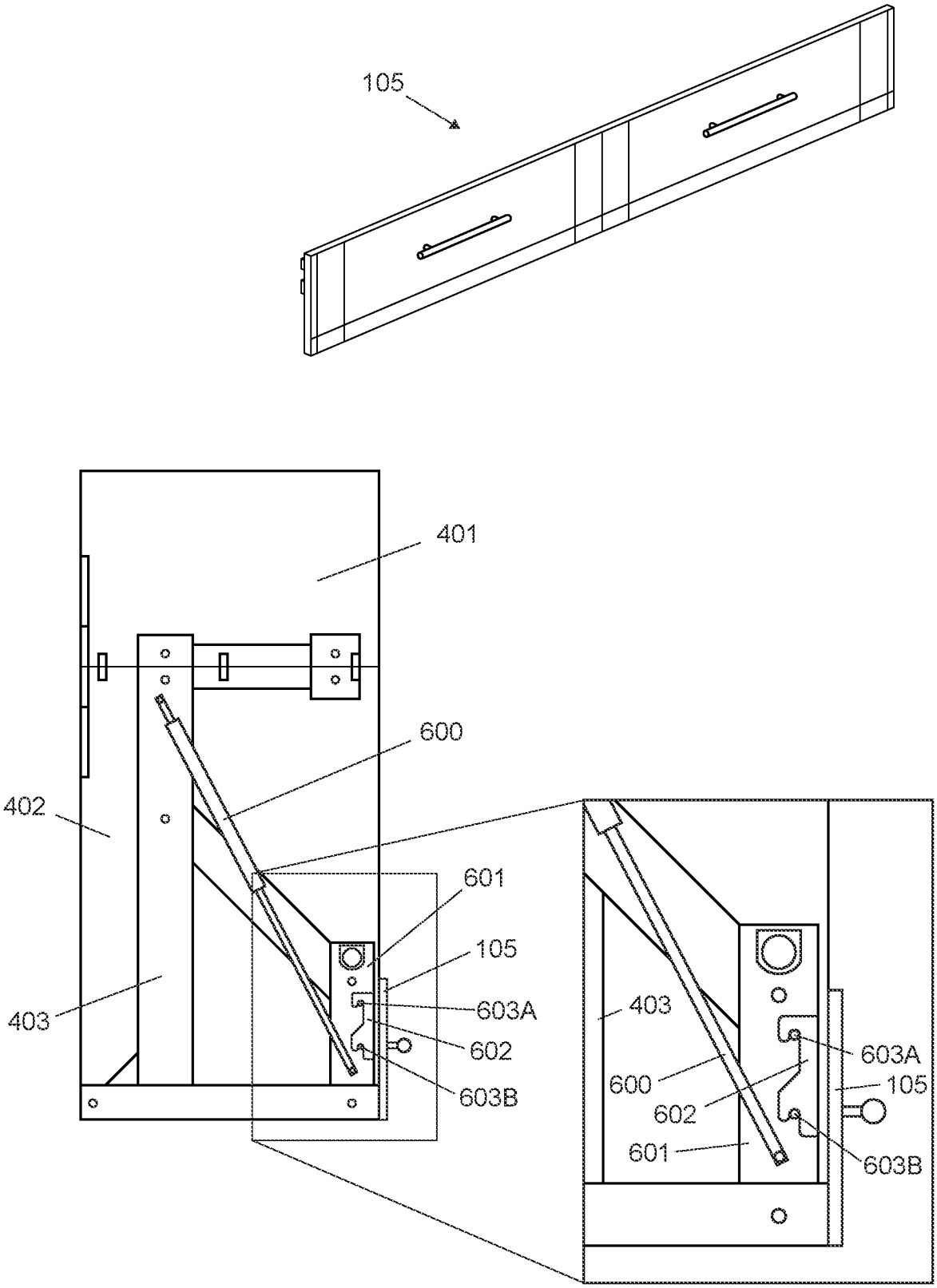
FIG. 6C is a side view of the front panel skirt of FIG. 1, and an expanded view of the left side of the counterbalance mechanism of FIG. 6A

FIG. 6C is a perspective view of the front panel 105 of FIG. 1, and an expanded, partial view of the counterbalance mechanism of FIGS. 6A and 6B. Front panel 105 comprises at least a first tray hook 602 configured to be removably coupled to right tray pivot structure 601. In exemplary embodiments, right tray pivot structure 601 comprises a first pivot point 603A and a second pivot point 603B. In preferred embodiments, at least the first tray hook 602 of front panel 105 is configured to be removably coupled to first pivot point 603A and a second pivot point 603B, so as to removably couple at least right tray pivot point structure 601 to front panel 105.

Figure 6D:
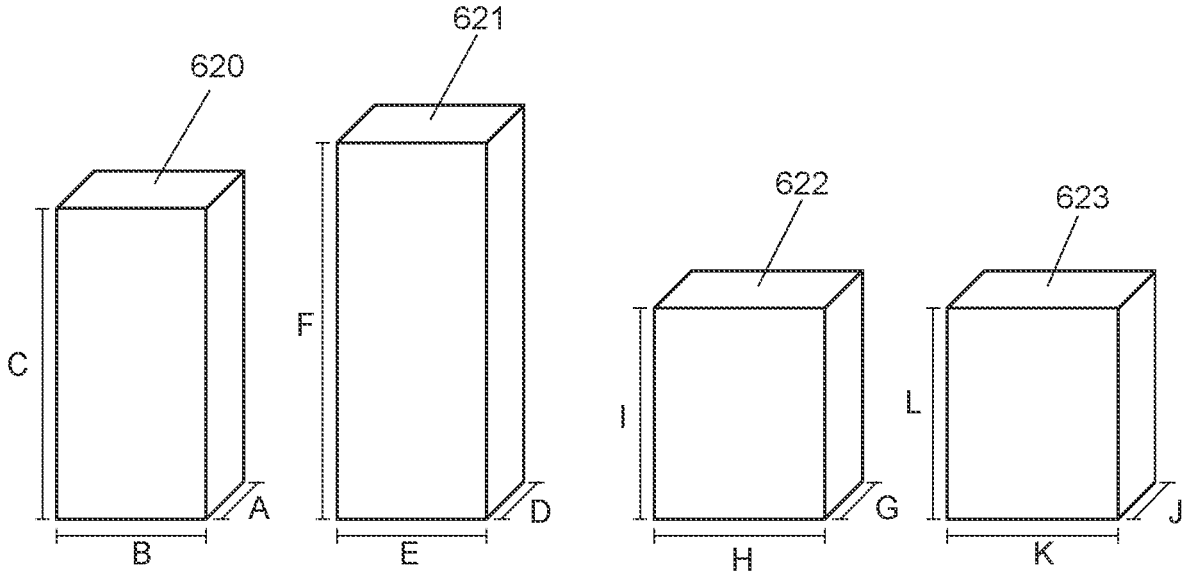
FIG. 6D is a front plan view of four parcel shipping containers.

FIG. 6D is a front plan view of four parcel shipping containers

The first container 620 has a depth of A, a width of B, and a length of C. In preferred embodiments, depth A is 14 inches, width B is 20 inches, and length C is 58 inches, for a total girth of 126 inches. The first container 620 is sized and dimensioned to contain the upper and lower panels for each of the first and second side walls, a first and second frame for the counterbalance mechanism, and one or more fasteners.

In exemplary embodiments, the upper panel 401 of left side wall 107 has a length of 54 inches, a width of 16 inches, and a depth of 1 inch. The lower panel 402 of left side wall 107 has a length of 31 inches, a width of 16 inches, and a depth of 1 inch. In related embodiments, the upper panel 501 of right side wall 202 has a length of 54 inches, a width of 16 inches, and a depth of 1 inch. The lower panel 502 of right side wall 202 has a length of 31 inches, a width of 16 inches, and a depth of 1 inch. The first frame 403, configured to be coupled to the inner surface of lower panel 402, has a length of 30 inches, a width of 16 inches, and a depth of 1 inch. The second frame 503, configured to be coupled to lower panel 502, has a length of 30 inches, a width of 16 inches, and a depth of 1 inch.

The second container 621 has a depth of D, a width of E, and a length of F. In preferred embodiments, depth D is 6.5 inches, width E is 20 inches, and length F is 69 inches, for a total girth of 122 inches. The second container 621 is sized and dimensioned to contain a top panel, one or more fasteners for rigidly coupling the top panel to the first and second side walls, a first back panel and one or more fasteners for rigidly coupling the back panel to the first and second side walls, a second back panel and one or more fasteners for rigidly coupling the second back panel to the upper panels of the first and second side walls, a bottom panel and one or more fasteners for rigidly coupling the bottom panel to the first and second side walls, and a flip foot rod.

In exemplary embodiments, the top panel 106 has a length of 63 inches, a width of 15 inches, and a depth of 1 inch. The first back panel 201 has a length of 63 inches, a width of 15 inches, and a depth of 1 inch. The second back panel 206 has a length of 63 inches, a width of 16 inches, and a depth of 1 inch. The bottom panel 207 has a length of 63 inches, a width of 15 inches, and a depth of 1 inch. The flip foot rod 205 has a length of 60, a width of 1 inch, and a depth of 1 inch.

The third container 622 has a depth of G, a width of H, and a length of I. The fourth container 623 has a depth of J, a width of K, and a length of L. In preferred embodiments, at least one of depth G and depth J is 7.75 inches, at least one of width H and width K is 33 inches, and at least one of length I and length L is 44 inches, for a total girth of 125.5 inches. In exemplary embodiments, the third container 622 is sized and dimensioned to contain the hingeably coupled first and second panels, and one or more fasteners. In preferred embodiments, the fourth container 623 is sized and dimensioned to contain the hingeably coupled third and fourth panels, one or more tray skirt hooks, one or more mattress hoops, one or more flip foots, at least one piston, and one or more fasteners.

The first panel 101 of first panel pair 109 has a length of 41, a width of 30, and a depth of 1 inch. The second panel 102 of first panel pair 109 has a length of 41, a width of 30, and a depth of 1 inch. In its closed configuration, first panel pair 109 has a length of 40 inches, a width of 28 inches, and a depth of 4 inches. First panel pair 109 is comprised of first panel 101 and second panel 102 in a fastened configuration. The third panel 103 of second panel pair 110 has a length of 34 inches, a width of 30, and a depth of 1 inch. The fourth panel 104 of second panel pair 110 has a length of 34 inches, a width of 30, and a depth of 1 inch. The second panel pair 110 has a length of 31 inches, a width of 30, and a depth of 4 inches. Second panel pair is comprised of third panel 103 and fourth panel 104 in a fastened configuration. In preferred embodiments, at least one of the tray skirt hooks has a length of 3 inches, a width of 2 inches, and a depth of 1 inch. Further, at least one mattress hoop has a length of 15 inches, a width of 6 inches, and a depth of 2 inches. Each one of flip feet 204 have a length of 11 inches, a width of 6 inches, and a depth of 1 inch.

In preferred embodiments, at least one of the containers is a foldable cardboard box having a Package Measurement of 130 inches or less. Moreover, each door and side wall combination can be advantageously shipped in containers where the weight of each container is at most 70 lbs. Each panel and side wall combination is pre-assembled and can be quickly assembled by coupling each panel pair and associated side wall, coupling the bed tray with the counterbalance mechanism, and attaching the horizontal panels to the housing with fasteners. It is also contemplated that each of the first panel pair and second panel pair and side wall combinations can be shipped together in one container to reduce the number of containers. Further, it should be appreciated that each set of fasteners can be packed either in the container which contains the specific components it is configured to fasten, or in one container with all other sets of fasteners packed therein. Preferably, the entire housing can be shipped in four boxes or less. In this manner, the inventive subject matter provides an improved Murphy bed that is easy to install (e.g., less steps) and more economical to ship.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints and open-ended ranges should be interpreted to include only commercially practical values. The recitation of ranges of values herein is merely intended to serve as a shorthand method of referring individually to each separate value falling within the range. Unless otherwise indicated herein, each individual value within a range is incorporated into the specification as if it were individually recited herein. Similarly, all lists of values should be considered as inclusive of intermediate values unless the context indicates the contrary.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification or claims refer to at least one of something selected from the group consisting of A, B, C . . . and N, the text should be interpreted as requiring only one element from the group, not A plus N, or B plus N, etc.

What is claimed is:

1. A foldout bed, comprising:

a pivoting bed tray transitionable between an open configuration and a closed configuration comprising a first panel, a second panel, a third panel, and a fourth panel, wherein the first and second panels are coupled and the third and fourth panels are coupled, and one or more fasteners for coupling the first and second panels with the third and fourth panels to form a unitary planar surface that extends from a left side of a housing to a right side of the housing and that is configured to support a mattress and a person when in the open configuration;

a first side wall comprising an upper panel and a lower panel;

a second side wall comprising an upper panel and a lower panel;

a top panel and one or more fasteners for coupling the top panel to the first and second side walls;

a counterbalance mechanism for coupling the pivoting bed tray to the first and second side walls comprising a first frame, a second frame, one or more fasteners for rigidly coupling the first frame to the first side wall, and one or more fasteners for rigidly coupling the second frame to the second side wall;

a front panel sized and dimensioned to extend horizontally between the first side wall and the second side wall and configured to couple with the first and second frames of the counterbalance mechanism, wherein the first frame and the second frame each have a base flange disposed perpendicular to the first side wall and the second side wall when rigidly coupled with the first side wall and the second side wall;

wherein the unitary planar surface area is at least 3500 inches squared; and wherein (i) the first and second panels are sized and dimensioned to fit in a container that has a Package Measurement of 130 inches or less, (ii) the third and fourth panels are sized and dimensioned to fit in a container that has a Package Measurement of 130 inches or less, (iii) the first and second side walls are sized and dimensioned to fit in a container that has a Package Measurement of 130 inches or less and (iv) the top panel and the front panel are sized and dimensioned to fit in a container that has Package Measurement of 130 inches or less.

2. The foldout bed of claim 1, further comprising a first flip foot rod for positioning the bed tray in the open configuration.

3. The foldout bed of claim 1, wherein the counterbalance mechanism further comprises a first piston and a second piston that couple with the first frame and second frame, respectively.

4. The foldout bed of claim 1, further comprising a first and second tray hook for coupling the front panel to the first and second frames, respectively.

5. The foldout bed of claim 1, wherein the first and second panels are disposed above the third and fourth panels.

6. The foldout bed of claim 1, wherein the first and second panels have a width of at least 30 inches and a length of at least 40 inches.

7. The foldout bed of claim 1, wherein the third and fourth panels have a width of at least 30 inches and a length of at least 40 inches.

8. The foldout bed of claim 1, wherein the upper panel of the first side wall and second side wall each have a width of at least 15 inches and length of at least 50 inches.

9. The foldout bed of claim 1, wherein the lower panel of the first side wall and second side wall each have a width of at least 15 inches and length of at least 30 inches.

10. The foldout bed of claim 1, wherein the top panel has a width of at least 15 inches and a length of at least 60 inches.

11. The housing of claim 1, wherein the front panel has a width of at least 9 inches and a length of at least 60 inches.

12. The foldout bed of claim 1, wherein the unitary planar surface has a width of at least 50 inches and a length of at least 70 inches.

13. The foldout bed of claim 1, wherein at least one of the containers has a weight of at most 70 lbs.

14. The foldout bed of claim 1, wherein the base flange has one or more holes.

15. A foldout bed, comprising:

a first side wall coupled with a first counterbalance mechanism;

a second side wall coupled with a second counterbalance mechanism;

a top panel coupled with the first and second side walls;

a pivoting bed tray comprising a unitary planar surface rotatably coupled with the first counterbalance mechanism and the second counterbalance mechanism and transitionable between an open configuration and a closed configuration, wherein the pivoting bed tray is configured to support a mattress and a person when in the open configuration;

wherein the first counterbalance mechanism comprises a first frame and a first piston;

wherein the second counterbalance mechanism comprises a second frame and a second piston;

wherein the first frame and the second frame are rigidly coupled to the first side wall and the second side wall, respectively;

wherein the first frame and the second frame each have a base flange disposed perpendicular to the first side wall and the second side wall; and a front panel extending horizontally between the first side wall and the second side wall and coupled with the first and second frames of the counterbalance mechanism.

16. The foldout bed of claim 15, wherein the base flange has one or more holes.

17. The foldout bed of claim 15, wherein the base flange of the first side wall and the second side wall are disposed at a bottommost end of the first side wall and the second side wall, respectively.

18. The foldout bed of claim 15, wherein the base flange of the first side wall and the second side wall are disposed at a rearmost side of the first side wall and the second side wall, respectively.

* * * * *